US008419864B2

(12) United States Patent
Haltmayer et al.

(10) Patent No.: US 8,419,864 B2
(45) Date of Patent: Apr. 16, 2013

(54) DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 619 days.

(21) Appl. No.: 12/641,389

(22) Filed: Dec. 18, 2009

(65) Prior Publication Data

US 2010/0156256 A1 Jun. 24, 2010

(30) Foreign Application Priority Data

Dec. 19, 2008 (DE) ..... 10 2008 054 971

(51) Int. Cl.
*B08B 3/00* (2006.01)

(52) U.S. Cl.
USPC ..... 134/56 D; 134/57 D; 312/288; 312/228.1

(58) Field of Classification Search ..... 134/56 D
See application file for complete search history.

(56) References Cited

U.S. PATENT DOCUMENTS 5,251,939 A * 10/1993 Jordan ..... 285/24

FOREIGN PATENT DOCUMENTS

DE 3614345 C1 9/1987
DE 102007057515 A1 6/2009

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A dishwasher includes a wash compartment with a retainer, a water connector supported by the retainer and that connects a supply line from a water supply network to a liquid line system of the dishwasher.

16 Claims, 5 Drawing Sheets

Detail Z

DISHWASHER

BACKGROUND OF THE INVENTION

Provided below the wash compartment of a dishwasher are a plurality of appliance components connected in the hydraulic circuit, for example a sump, a wash liquor pump or a circulating pump, which are supplied with fresh water by way of a water connector assembled in the dishwasher.

A generic dishwasher has such a water connector, by way of which a supply line from the water supply network can be connected to the liquid line system of the dishwasher.

The water connector can for example be a water inlet valve with an assigned support plate. When the dishwasher is being assembled at the factory the water inlet valve can be inserted into a pocket-type holder in the assembly base of the dishwasher. The wash compartment is then positioned on the assembly base.

BRIEF SUMMARY OF THE INVENTION

When the dishwasher has been assembled in this manner the water connector is not easily accessible from outside. It is therefore very time-consuming to remove or replace it. Handling of the dishwasher during a final factory inspection after assembly is also problematic. During such a final inspection the operation of the dishwasher, which has been almost completely assembled on an assembly line, is tested. To this end a test facility makes contact with the water connector to supply the dishwasher with test water.

An object of an exemplary embodiment of the invention is to provide a dishwasher, which is simple to assemble and with which the processes of the final factory inspection are simple to accomplish.

An exemplary embodiment of the invention is based on a dishwasher with a wash compartment and a water connector, with which a supply line from the water supply network can be connected to a liquid line system of the dishwasher.

A base wall of the wash compartment has a retainer, on which the water connector is supported. Contrary to the prior art, the water connector is therefore not provided on an assembly base of the dishwasher but at a distance from it on a wash compartment wall, in particular on the wash compartment base wall. The water connector can thus be provided in a position on the wash compartment that is easily accessible for final inspection and/or subsequent removal.

It is simple from a manufacturing point of view, if the retainer for the water connector is integrated in the same material and/or as a single piece on the wash compartment, in particular in its base wall. The base wall with integrated retainer can be produced simply from a manufacturing point of view using plastic injection molding. The base wall is thus economically a plastic part, on which the remaining wash compartment walls made of stainless steel sheet are positioned.

The water connector can have a support plate for example, which is assembled on the inventive retainer. The support plate can also support a water inlet valve embodied as an electromagnetic valve, the outlet side of which is connected to the hydraulic circuit of the dishwasher. To ensure simple positioning of the water hose with reduced installation length, the retainer can project from the wash compartment base wall into the assembly space below, in which the sump and other appliance components connected to the liquid circuit are assembled.

The retainer can preferably be positioned at a free height above the dishwasher standing surface. The retainer with the water connector assembled thereon is thus disposed in an easily accessible position away from the assembly base or dishwasher standing surface.

For simple access the retainer can have an assembly wall, to which the water connector can be assembled. The assembly wall can be molded on the front face of the base wall of the wash compartment and project downward in the region of the loading opening of the wash compartment. The assembly wall can also bound a tool access opening to the assembly space on the front face. Thus when the front panel is removed from the dishwasher, the assembly space and therefore the water connector can be easily assembled/removed by means of tool access.

For simple assembly of the water connector the holding element can have an open assembly recess, in particular open to the front face of the appliance. The preferably pocket-type assembly recess can assist with the positionally accurate positioning of the water connector in the manner of an insertion shaft by means of its side walls.

It is advantageous for process purposes, if the water connector and other appliance components are assembled when the wash compartment base wall is upside down. In this assembly position the lower face of the base wall therefore faces upward.

To further simplify assembly, the retainer molded on the base wall can have a through opening that is preferably open to the base face, through which the water connector can project. When the base wall is in the assembly position mentioned above, the through opening advantageously has an insertion face that opens upward, by way of which the water connector can be introduced into the through opening. The open insertion face can also be bounded by assembly bevels. When the water connector is inserted, its support plate can be disposed on the front face of the retainer, while the water inlet valve projects through the through opening into the appliance interior.

To further accelerate the assembly process the water connector inserted into the through opening can be centered and held automatically, i.e. without additional manual support, in a pre-assembly state. Subsequent fixing of the water connector on the retainer can therefore take place without additional manual verification of the position of the already pre-positioned water connector.

For the above-mentioned pre-positioning the retainer can have the above-mentioned positioning stops, in particular on both sides of the through opening, in other words a height stop, which determines the height position of the water connector, a side stop, which pre-centers the water connector laterally and/or at least one depth stop, against which the water connector abuts in the depth direction. It is preferable for assembly purposes and favorable in respect of space, if all the positioning stops are disposed in a concentrated manner within the assembly recess.

In a simple configuration, which is particularly suitable for injection molding, the depth stop can be a supporting rib projecting from the retainer. A height stop can also be integrated in the supporting rib, limiting the insertion movement of the water connector vertically downward into the through opening.

Alternatively and/or additionally the depth stop can also be a supporting flange, which partially bounds the through opening. The supporting flange and supporting rib can be connected to one another by way of at least one web part for stiffening purposes. The web part can have a double function by being formed as a screw boss, to which the pre-assembled water connector can be screwed. Side stops can also be provided as insertion aids on the side walls of the assembly recess. These side stops can project in the manner of ribs from the side walls of the assembly recess.

For positionally accurate pre-positioning of the water connector the retainer can also be assigned a rocker stop, which provides an additional support point for the water inlet valve. The rocker stop can preferably be disposed some distance from the positioning stops and/or outside the assembly recess. As a result the rocker stop, together with the positioning stops, can provide a generally stable support base for the water connector.

As mentioned above, after pre-positioning the water connector is fixed to the retainer, in particular screwed to it. The torque resulting during screwing can cause the water connector to move from its pre-positioned position, thereby having an adverse effect on the operationally reliable and at the same time accelerated assembly of the water connector.

With this in mind, the water connector can have at least one form-fit segment, perhaps a lateral flange, which is connected in a form-fit manner to the retainer, such that the torque resulting during screwing can be absorbed.

In the case of large scale manufacture in particular the operational capacity of every dishwasher is generally checked as part of a final inspection. To this end an automatic contact between a test facility and the water connector is advantageous in respect of processes. Such an inspection takes place at the factory at the end of an assembly line when the dishwasher is almost fully assembled. The positionally accurate positioning of the water connector, as can be established by means of the above-mentioned positioning stops, is important for such automatic contact.

During the automatic contact taking place within the context of the final inspection a test facility is brought into contact with the water connector with a predetermined force. In order in this process to prevent deflection of the retainer, the retainer is embodied with an additional stiffening structure, for example stiffening ribs. The retainer is therefore configured as a stable counter-bearing to absorb force during contact.

BRIEF DESCRIPTION OF THE DRAWINGS

An exemplary embodiment of the invention is described below with reference to the accompanying figures, in which.

DETAILED DESCRIPTION OF EXEMPLARY EMBODIMENTS OF THE PRESENT INVENTION

Figure 1:
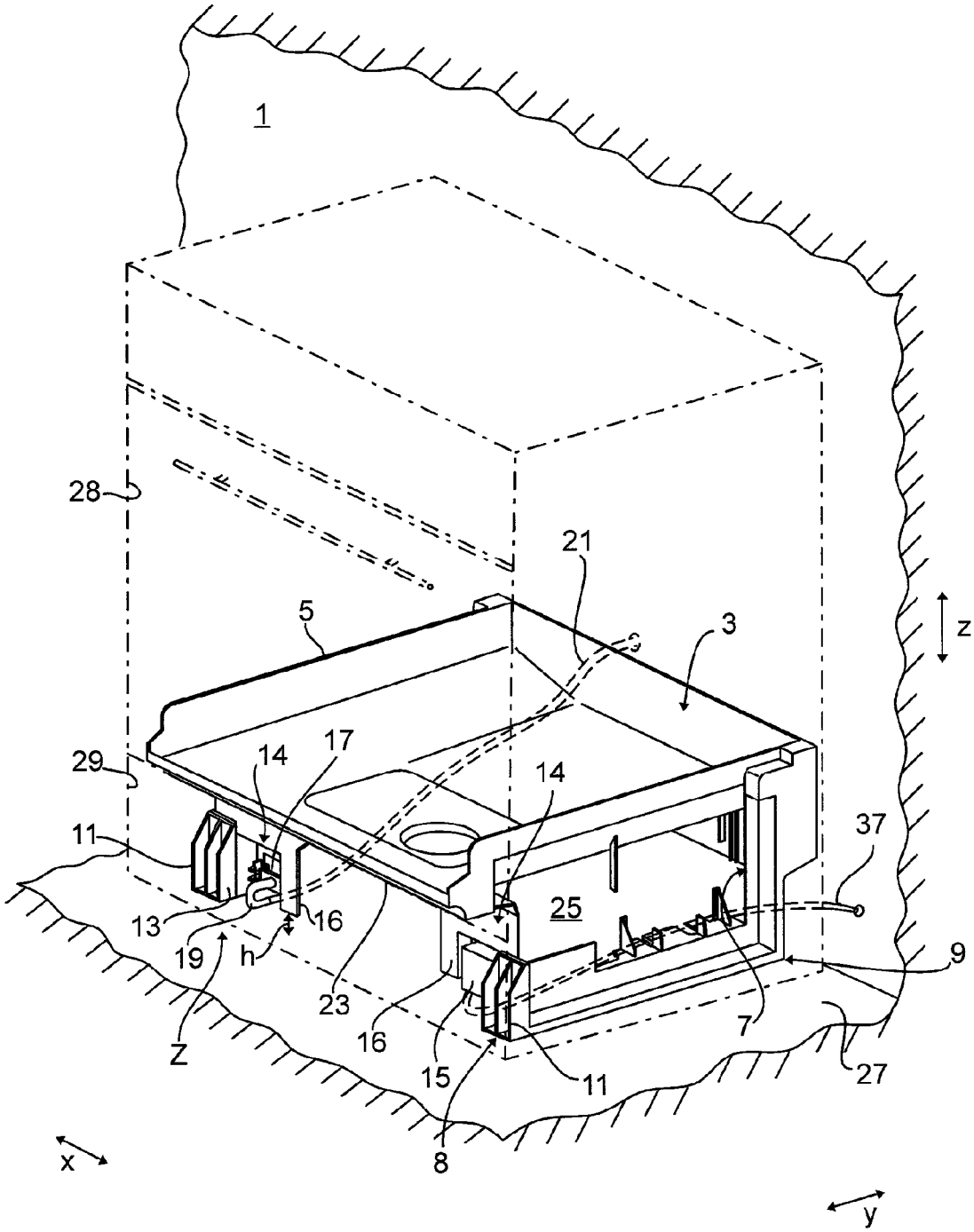
FIG. 1 shows a roughly schematic diagram of a fully installed dishwasher.

FIG. 1 shows a roughly schematic, perspective diagram of a dishwasher installed on a side wall 1. The housing walls and appliance door of the dishwasher are only shown with a dot-dash line for reasons of clarity. In order to be able to understand the invention more easily only a base wall 3 of the wash compartment of the dishwasher is shown, the wash compartment as a whole and the known appliance components such as the sump, circulation pump, wash liquor pump and electronic control system components not being shown.

The wash compartment base wall 3 shown in FIG. 1 is manufactured here by way of example as a plastic injected molded part. The base wall 3 is provided with laterally elevated peripheral faces 5, on which rest the side walls (not shown) of the wash compartment, the remainder of which is made of stainless steel sheet. The base wall 3 bounds a wash chamber at the base.

Molded on each of the outer faces of the base wall 3, which are opposite one another in the appliance side direction x, is a supporting frame 7, which has appliance feet (not shown) at its front and/or rear corner regions 8, 9 respectively. The two lateral supporting frames 7 have guide shafts 11 at each of their front corner regions 8, in which the device feet are guided with vertical movement. Retainers 14 for a power network connection element 15 and for a water connector 17, which is assigned to the hydraulic circuit of the dishwasher, are configured respectively on the facing side walls 13 of the guide shafts 11. Each of the two retainers 14 has an assembly wall 16, which is molded on the assigned guide shaft side wall 13 and to the lower face of the base wall 3. The water connector 17 is assembled on the left assembly wall 16 shown in FIG. 1 by means of a support plate 41 described below, to which an outlined elbow 19 of a supply hose 21 leading to the water supply network is connected.

The two assembly walls 16 on the front face bound a central tool access opening 23 to an assembly space 25 below the wash compartment base wall 3. The assembly space 25 is not bounded at its base by a closed assembly floor of the dishwasher but is configured as open.

As is also shown in FIG. 1, the two assembly walls 16 of the respective retainers 14 on the front face are a free height h away from the standing surface 27 of the dishwasher, thereby making access easier for assembling or removing the water connector 17 or the power network connection element 15. Only a panel 29 provided on the front face below the appliance door 28 has to be removed to take out said components. This exposes the tool access opening 23 and provides easy access to the securing elements of the water connector 17 or the power network connection element 15.

A network cable 37 leading from the power supply network is connected by way of the power network connection element 15 to electric lines 38, which supply the electrically operated appliance components with power.

Figure 3:
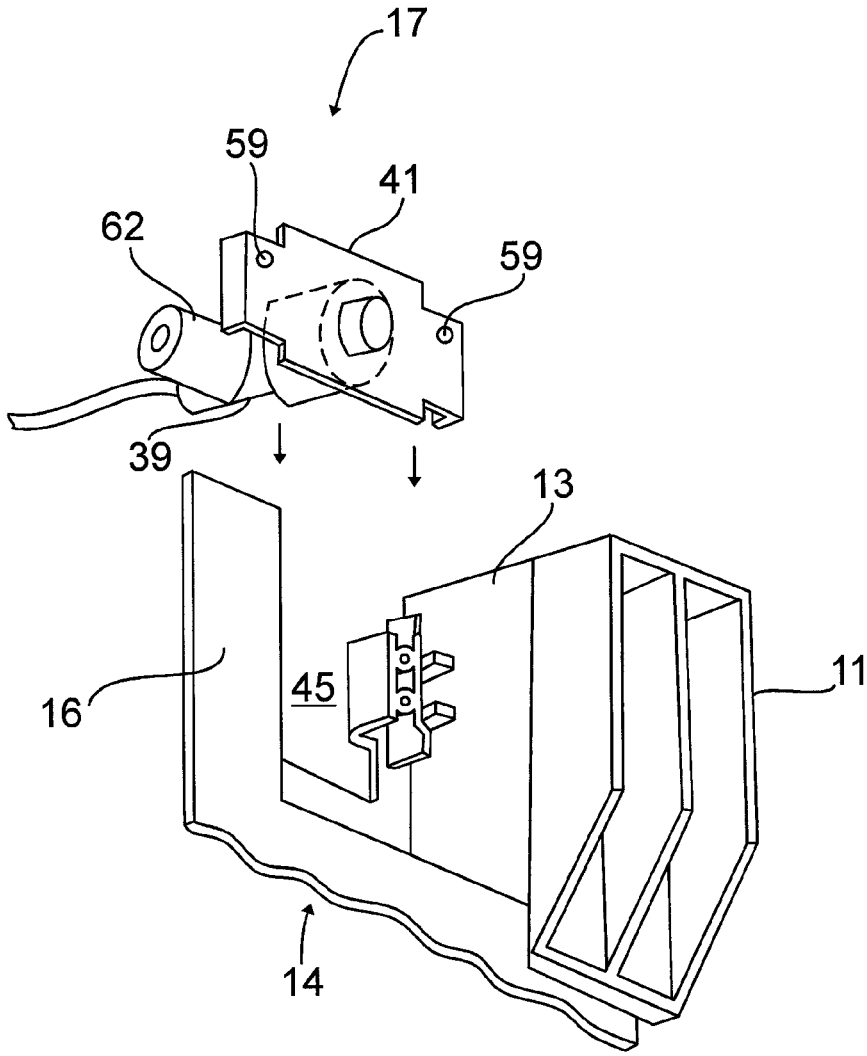
FIG. 3 shows a view like the one in FIG. 2 with the water connector removed.

According to FIG. 3 the water connector 17 has a water inlet valve 39 embodied as an electromagnetic valve and a support plate 41 holding the water inlet valve 39. Both components can be assembled as a single-piece structural unit to the retainer 14 during dishwasher assembly.

Figure 2:
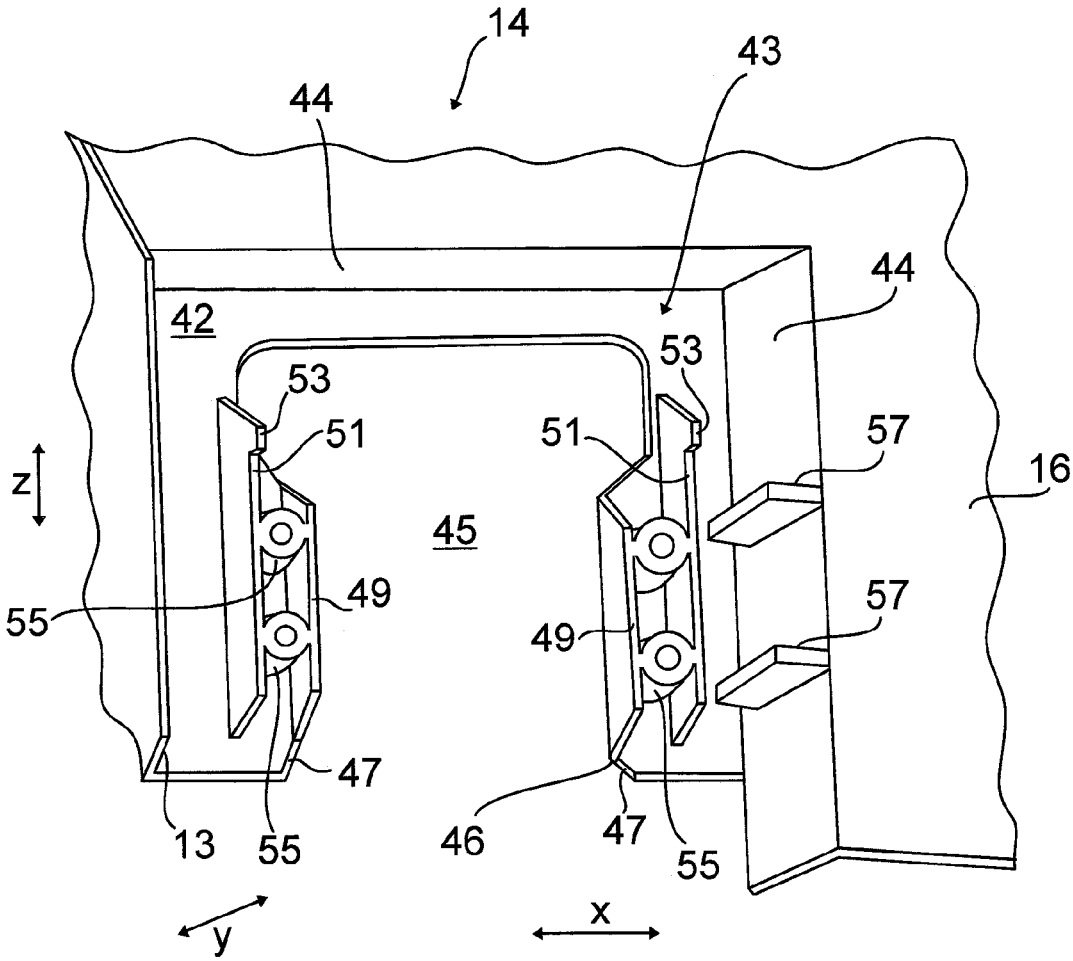
FIG. 2 shows an enlarged partial view of the detail Z from FIG. 1, in which the inventive retainer is shown in isolation.

In FIG. 2 the retainer 14 for holding the water connector 17, which is molded on the wash compartment base wall 3, is shown in isolation. The assembly wall 16 of the retainer 14 therefore has an assembly recess 43, which is open to the front face of the appliance. This is embodied as roughly rectangular and is bounded by side walls 44 and the guide shaft side wall 13 and configured to open in a downward direction. A through opening 45 is provided in the base 42 of the assembly recess 43, having an insertion face 46, which is open at the base. The through opening 45 is bounded at the edges at its open insertion face 46 by assembly bevels 47 extending laterally downward. The two opposing assembly bevels 47 form an insertion aid when the water connector 17 is introduced into the through opening 45 of the retainer 14.

For positionally accurate centering of the water connector 17 in the through opening 45 of the retainer 14, positioning stops are provided within the assembly recess 43 according to FIG. 2. Supporting flanges 49 are thus molded on the peripheral faces of the through opening 45. Parallel supporting ribs 51 with a lateral outward offset to these are provided respectively on the base 42 of the assembly recess 43. Both the supporting flanges 49 and the supporting ribs 51 form a depth stop, which secures the support plate 41 of the water connector 17 in the appliance depth direction y.

Projections 53 are molded on the two upper ends of the supporting ribs 51 away from the insertion face 46 and act as height stops to determine a height position of the support plate 41. Screw bosses 55 are positioned between the supporting flanges 49 and supporting ribs 51 disposed on both sides of the through opening 45 and connect the supporting ribs 51 respectively to the supporting flanges 49 in the manner of a connecting web. Further rib-type side stops 57, which center the support plate 41 in a lateral direction x, are provided with a lateral offset from the supporting ribs 51 in the appliance side direction x.

The assembly of the water connector 17 in the retainer 14 of the wash compartment base wall 3 is described with reference to FIG. 3. As shown in FIG. 3, the base wall 3 is moved into its assembly position first, with the lower face of the base wall together with the supporting frame 7 molded thereon projecting vertically upward. In the assembly state shown therefore the insertion face 46 of the through opening 47 is open vertically upward. The water connector 17 can therefore be inserted into the through opening 45 in a vertically downward assembly movement. To this end the support plate 41 of the water connector 17 is pushed over the supporting flange 49 and the supporting ribs 51 until it comes to rest against the projections 53 molded thereon.

In this pre-assembly state the two upper screw bosses 55 according to FIG. 3 are aligned with the screw holes 59 in the support plate 41. So that the water connector 17 remains positioned in a stable manner, i.e. without additional manual support, in the pre-assembly state, the assembly wall 16 has an additional support point 60 or rocker stop on its rear face according to FIG. 4, against which a retaining bracket 61 of an electromagnetic coil 62 of the water inlet valve 39 abuts in the pre-assembly state.

Figure 5:
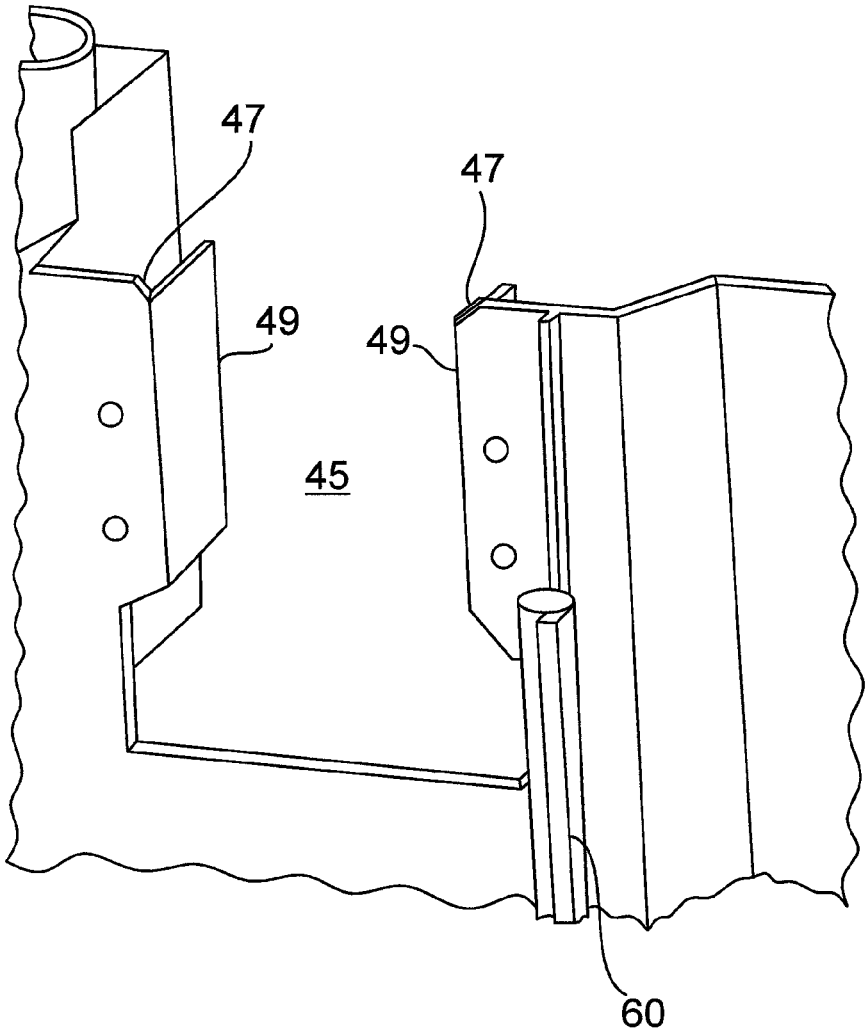
FIG. 5 shows a view of the retainer from the rear with the water connector removed.

The rocker stop 60 is a strip running in the height axis direction, which at the same time also serves to stiffen the retainer 14. The water connector 17 is thus centered in an operationally secure manner in its pre-assembly position. According to FIG. 5 the rocker stop 60 is molded on the rear face of the assembly wall 16 in the manner of a strip-type material reinforcement.

During subsequent finally assembly the support plate 41 of the water connector 17 is screwed using tension screws (not shown). The final assembly state is shown from above in the view in FIG. 4. The support plate 41 therefore has a screw connection 65 to the two opposing screw bosses 55.

Figure 4:
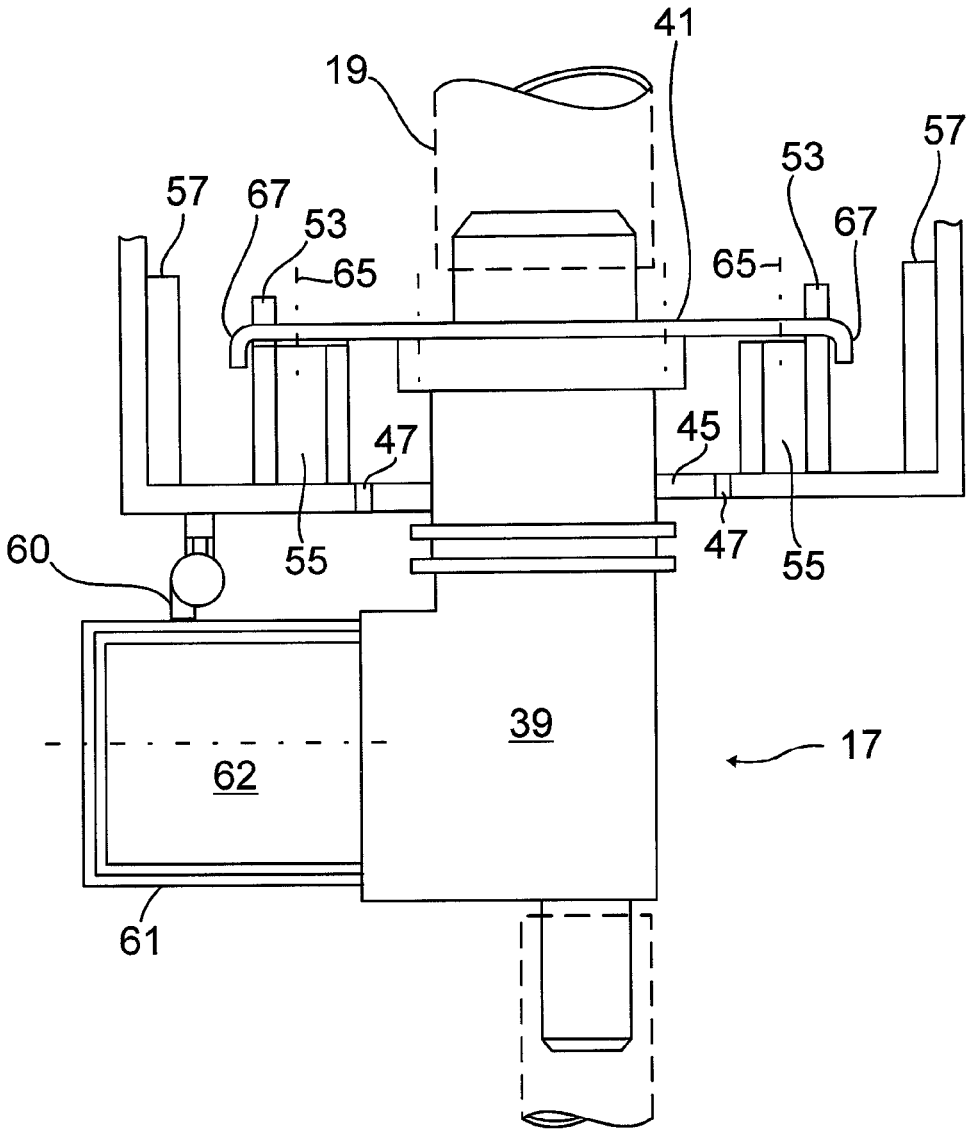
FIG. 4 shows a view from above of the water connector assembled in the retainer.

As also shown in FIG. 4, the support plate 41 has laterally angled peripheral flanges 67, which engage laterally over the two supporting ribs 51 almost without play. The form-fit connection between the peripheral flanges 67 of the support plate 41 and the supporting ribs 51 means that the torque acting on the screw bosses 55 of the retainer 14 when the water connector 17 is tightened can be absorbed. The water connector 17 therefore remains reliably in its pre-positioned position even during the screwing operation.

What is claimed is:

1. A dishwasher comprising:

a front door;

an access panel;

a wash compartment for cleaning crockery with a retainer that is unitary to an injection molded portion of a base wall of the wash compartment;

a water connector supported and retained by the retainer that connects a supply line from a water supply network to a liquid line system of the dishwasher; wherein the access panel is mounted to the dishwasher at a position adjacent to and below the front door of the dishwasher, and the retainer is disposed at a position adjacent to and behind the access panel.

2. The dishwasher of claim 1, wherein the retainer projects from the base wall into an assembly space disposed below the wash compartment.

3. The dishwasher of claim 1, wherein the retainer and the water connector are located at a distance above a dishwasher standing surface.

4. The dishwasher of claim 1, wherein the retainer comprises an assembly wall on a front face of a wash compartment wall on which the water connector is supported.

5. The dishwasher of claim 4, wherein the assembly wall defines an assembly space below the wash compartment forming a tool access opening on a front face.

6. The dishwasher of claim 1, wherein the retainer comprises an assembly recess that is open to a front face of the appliance behind the access panel and into which the water connector can be introduced.

7. The dishwasher of claim 6, wherein the assembly recess comprises a height stop, a depth stop and/or a side stop within the assembly recess of the retainer.

8. The dishwasher of claim 1, wherein the retainer comprises a through opening, which is open on a base face, through which the water connector projects, with an open insertion face of the through opening being bounded by assembly bevels.

9. The dishwasher of claim 8, wherein the retainer comprises:

a height stop on both sides of the through opening, which determines a height position of the water connector; and a side stop, which centers the water connector laterally; and a depth stop against which the water connector abuts in a depth direction.

10. The dishwasher of claim 9, wherein the depth stop comprises a supporting rib which projects from the retainer and forms the height stop.

11. The dishwasher of claim 10, wherein the depth stop comprises a supporting flange which partially bounds the through opening.

12. The dishwasher of claim 11, wherein the supporting flange and the supporting rib are connected to one another with a screw boss.

13. The dishwasher of claim 9, wherein the side stop is on a side wall of the assembly recess.

14. The dishwasher of claim 1, wherein the retainer comprises a rocker stop, against which the water connector abuts prior to the water connector and retainer coming together in a fully connected position, said rocker stop being a distance from a positioning stop and/or outside the assembly recess.

15. The dishwasher of claim 1, wherein the water connector comprises a peripheral flange which is connected in a form-fit manner to the retainer and which absorbs torque acting when the water connector is screwed.

16. A method for assembling a dishwasher with a wash compartment having a retainer, and with a water connector supported by the retainer and that connects a supply line from a water supply network to a liquid line system of the dishwasher, the dishwasher including an access panel and a door, the access panel being located adjacent to and below the door of the dishwasher, with the retainer being located, in an installed position, adjacent to and behind the access panel and being unitary to an injection molded portion of a base wall of the wash compartment, the method comprising:

disposing a wash compartment base wall as a separate component in an assembly position; and assembling the water connector on the base wall.

* * * * *